United States Patent [19]

Lindermann et al.

[11] Patent Number: 4,813,382

[45] Date of Patent: Mar. 21, 1989

[54] COOLER FOR GASES GENERATED BY GASIFICATION

[75] Inventors: Wilhelm Lindermann, Oberhausen; Manfred Förster, Essen, both of Fed. Rep. of Germany

[73] Assignee: Deutsche Babcock Werke Aktiengesellschaft, Oberhausen, Fed. Rep. of Germany

[21] Appl. No.: 184,940

[22] Filed: Apr. 22, 1988

[30] Foreign Application Priority Data

Apr. 25, 1987 [DE] Fed. Rep. of Germany ..... 3713912

[51] Int. Cl.[4] ..... F22D 1/00

[52] U.S. Cl. ..... 122/7 R; 48/69; 122/6 A; 122/235 K

[58] Field of Search ..... 122/7 R, 7 C, 7 D, 32, 122/6 A, 235 K; 48/69

[56] References Cited

U.S. PATENT DOCUMENTS 4,546,731 10/1983 Ammahm ..... 122/235 K X
4,563,194 1/1986 Simon ..... 48/77
4,707,163 11/1987 Gudymov et al. ..... 122/7 R X

*Primary Examiner*—Edward G. Favors
*Attorney, Agent, or Firm*—Max Fogiel

[57] ABSTRACT

A cooler for gases generated from coal by gasification under pressure has a pressurized vessel (1) that accommodates an insert (5) with a polygonal cross-section made out of pipes (6) that are welded together gas-tight in conjunction with webs (7). The pipes in the insert are bent vertically in to create a roof (11) and parallel one another sector by sector with webs of uniform width. The pipes that abut at an angle at the edges of the sectors are united in pairs by forged crosstail butts (13). The crosstail butts are aligned along a straight line and completely occupy the spaces between the sectors.

4 Claims, 4 Drawing Sheets

COOLER FOR GASES GENERATED BY GASIFICATION

Figure 1:
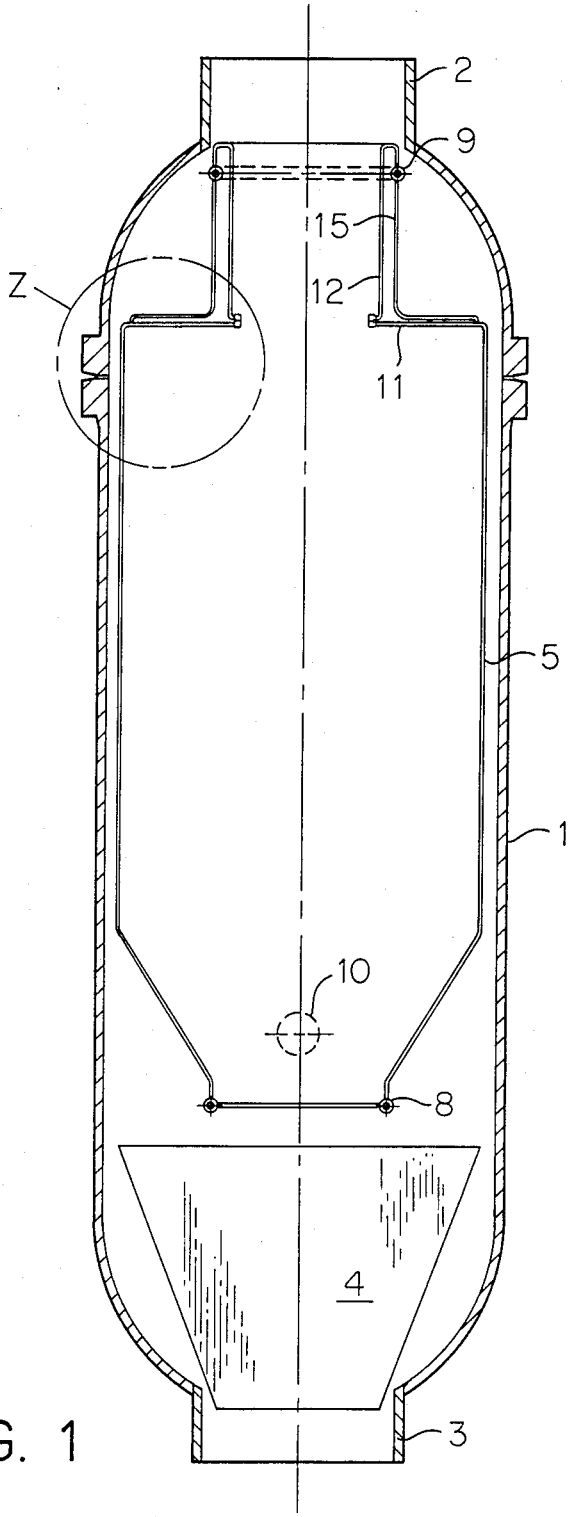

The invention concerns a cooler for gases generated from coal by gasification under pressure in accordance with the preamble to claim 1.

Some of the pipes in the insert in a known cooler (European Pat. No. 48 326) are bent into a wall of pipes in the form of a neck that functions as a gas line. The pipes in the vicinity of the bend constitute the roof of the insert. This patent, however, says nothing about how the pipes are bent out into or arrayed in the form of a roof.

The object of the present invention is to improve the generic cooler to the extent that the roof of the insert can be created by simple means.

This object is attained in accordance with the invention by the characteristics recited in the body of claim 1. Practical embodiments of the invention are recited in the subsidiary claims.

The pipes, which extend parallel inside the sectors, can be combined into a gas-tight roof by means of intermediate webs of uniform width. The triangular spaces left behind the sectors are sealed off gas-tight by the crosstail butts that unite the pipes, pairs of which abut together at an angle. The uniform distribution of the pipes in the roof in one practical embodiment makes it possible in a simple way to join the pipes in another, interior, insert into the roof by means of T-shaped connectors. Several embodiments of the invention are illustrated in the drawing and will now be specified.

Figure 2:
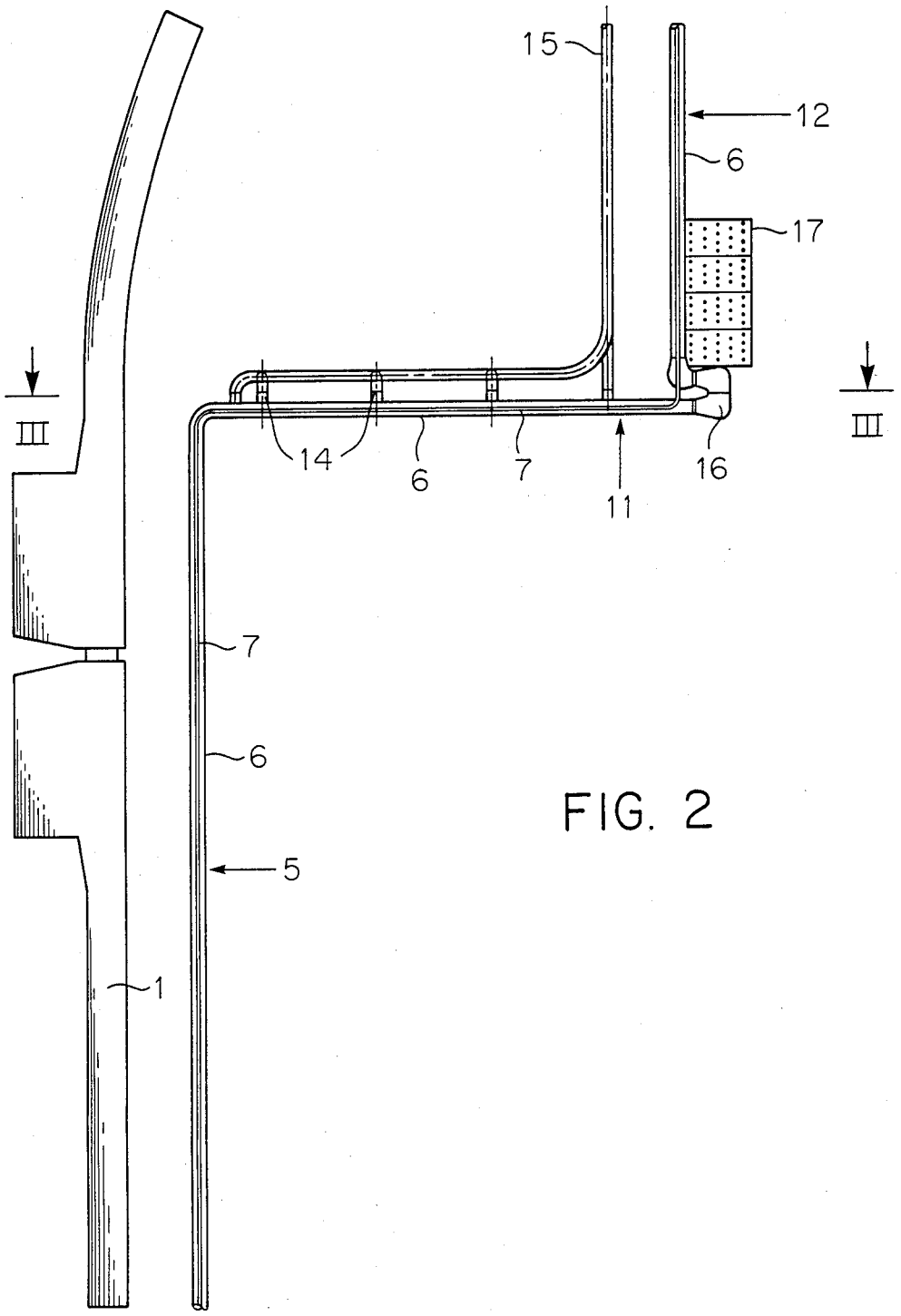
Figure 3:
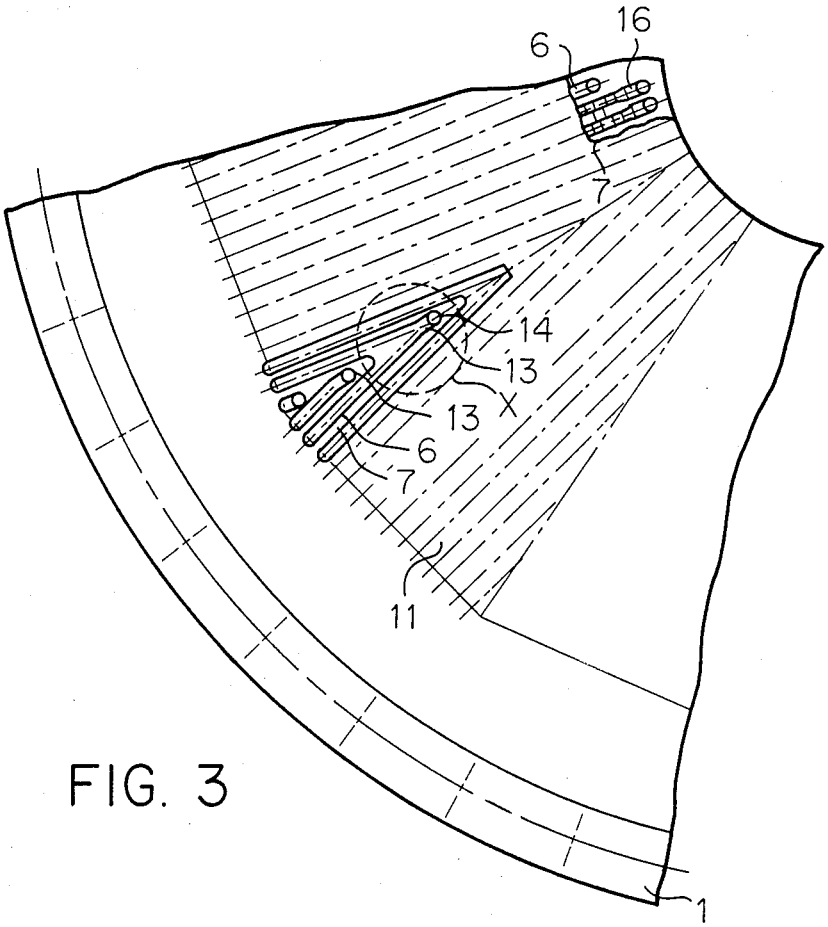
Figure 4:
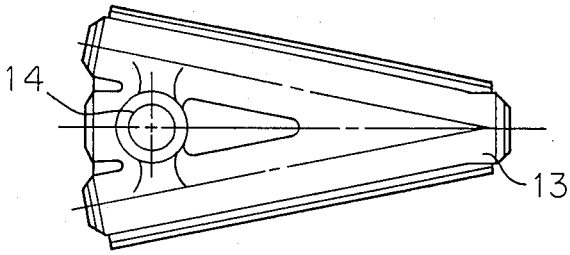
Figure 5:
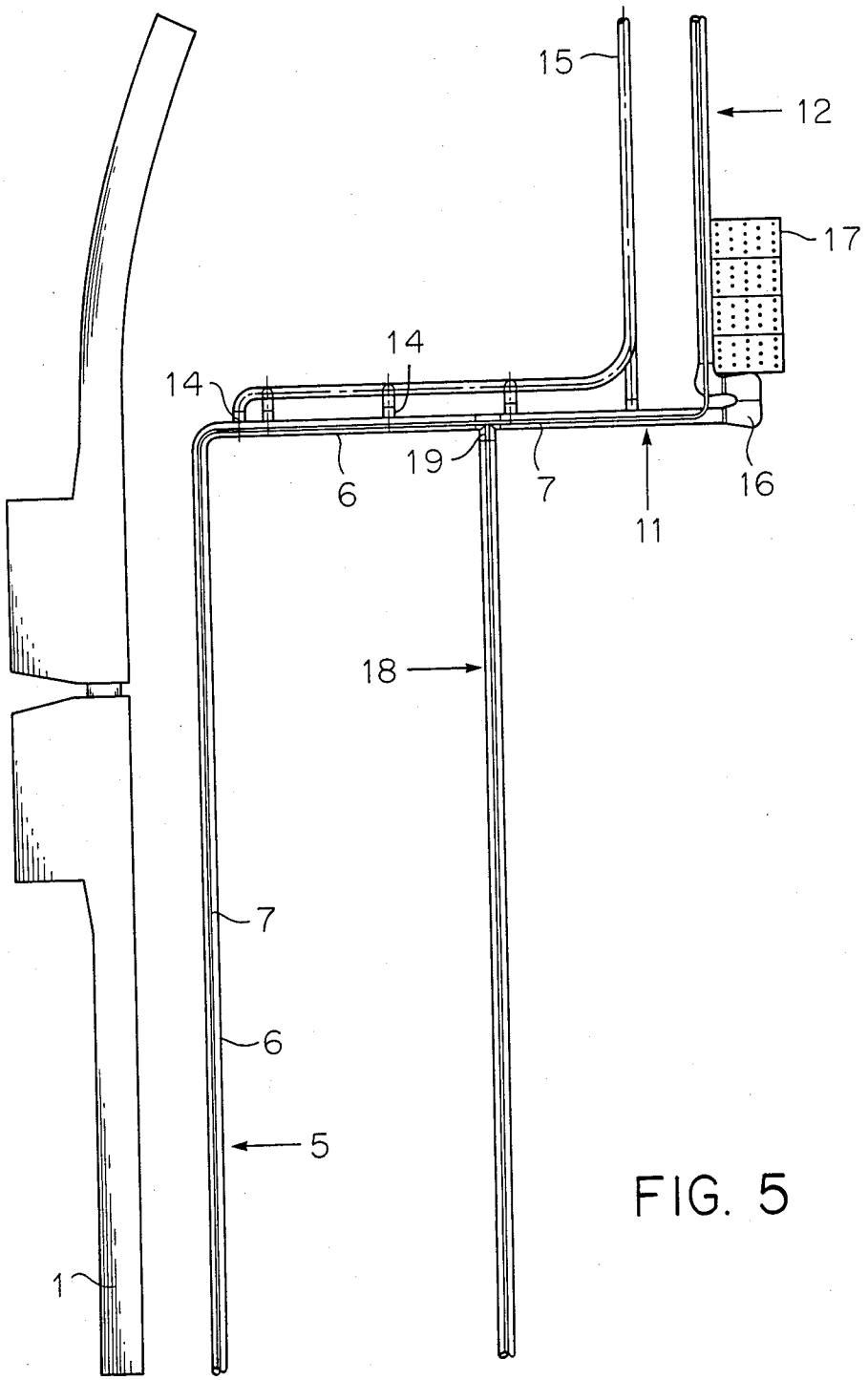

FIG. 1 is a longitudinal section through a cooler in accordance with the invention, FIG. 2 represents the detail Z in FIG. 1, FIG. 3 is a section along the line III—III in FIG. 1, FIG. 4 represents the detail X in FIG. 3, and FIG. 5 represents the detail Z in FIG. 1 in another embodiment of the invention. A cooler consists of a pressurized vessel 1 with an upper connection 2 and a lower connection 3. Upper connection 2 communicates with the outlet of a pressurized reactor, wherein a gas is generated by the gasification of coal. The gas is to be cooled in the cooler. The gasification residue in the gas is removed through lower connection 3. The wall of the housing is protected by means of an ash hopper 4 at the bottom of pressurized vessel 1.

Accommodated in pressurized vessel 1 is a refrigerated insert 5 that contains additional plate-shaped radiating surfaces. These surfaces are, for simplicity's sake, unillustrated. Insert 5 is in the form of a regular polygon built up out of n slabs. Each slab consists of vertical pipes 6 that are united into a gas-tight wall by webs 7. A coolant is supplied through a collector 8 at the bottom of insert 5, flows up through pipes 6, and is removed through another collector 9 at the top. The coolant is water that is vaporized in the pipes in insert 5 and removed from second collector 9 in the form of a mxture of water and steam.

The tapering bottom of insert 5 opens toward pressurized vessel 1. Connected to the wall of pressurized vessel 1 at a level above the bottom edge of insert 5 is a gas-removal connection 10.

To match the cross-section of upper connection 2, the pipes 6 in insert 5 are bent at the top, creating a roof 11 that merges into an intake section 12. Intake section 12 is comprised of some of the pipes 6 in insert 5, which are united by webs into a gas-tight wall of pipes.

As will be particularly evident from FIG. 3, the pipes 6 in each sector inside roof 11 extend parallel one to another and to the vertical midline of each side of the polygonal insert 5. Pipes 6 are welded in conjunction with webs 7 into a gas-tight wall. The width of the webs matches the distribution of the pipes in insert 5 and roof 11. The sector-by-sector parallel orientation of pipes 6 leaves triangular spaces between the sectors. Each pair of pipes 6, which abut at an angle in the vicinity of these intermediate triangular spaces, is fastened together by a forged crosstail butt 13. Each crosstail butt 13 has two pipe connections at the rear to secure it to a pair of pipes, and tapers toward its closed forward end. Crosstail butts 13 are distributed along a straight line that slopes toward the longitudinal axis of insert 5 in such a way that the front end of each crosstail butt 13 is secured to the next crosstail butt between the latter's pipe connections. The conically tapering longitudinal edges of each crosstail butt 13 parallel the axes of the pipes in the adjacent sector of roof 11. Shaped onto each crosstail butt 13 at a right angle is a pipe connection 14. The pipe connections 14 on the aligned crosstail butts 13 communicate with a pipeline 15 that extends outside of intake section 12 into upper collector 9.

The pipes 6 that are not united by crosstail butts 13 extend into elbows 16 and constitute the wall of intake section 12. Elbows 16 project inward and create brackets that support a fireproof lining 17 for refrigerated intake section 12.

The aforesaid design for roof 11 makes it possible in a simple way to install an additional, interior, insert 18. Insert 18 has, like outer insert 5, a polygonal cross-section, with the sides of the polygons paralleling each other. Insert 18 consists of a gas-tight wall of pipes. The distribution of its pipes and the width of its webs equal those in insert 5. The pipes 6 in roof 11 are separated, and each accommodates the foot of a tubular T-shaped connector 19 that is welded to the accordingly separated pipe sections. Each pipe in interior insert 18 is fastened to the downwardly oriented web of a T-shaped connector 19, securing the wall of that insert into the roof.

We claim:

1. A cooler for gases generated from coal gasification under pressure, comprising: an insert having pipes welded together gas-tight in conjunction with webs; said insert having a cross-section of a regular polygon of n sides; said pipes in said insert being bent vertically to form a roof and an adjoining intake section; said pipes comprising said roof of said insert being parallel to one another sector by sector and having webs of uniform width; pipes abutting at an angle at edges of said sectors being united in pairs by forged crosstail butts; a pipe connection being shaped at an angle on each of said crosstail butts; said crosstail butts being aligned along a straight line and occupying completely spaces between said sectors.

2. A cooler as defined in claim 1, wherein pipes in one side of said polygon are parallel to a vertical midline of said side.

3. A cooler as defined in claim 1, including an elbow, each pipe in said intake section communicating through said elbow with another pipe in said roof, said elbow projecting inward; and a fireproof lining resting on said elbow.

4. A cooler as defined in claim 1, including another insert comprised of pipes welded together gas-tight and with a polygonal cross-section of n sides inside said first insert; sides of the polygons being parallel to each other; and a T-shaped connector for uniting each pipe in the other insert into said roof comprised of pipes in said first-mentioned outer insert.

* * * * *